United States Patent [19]

Ikeda et al.

[11] Patent Number: 4,773,435

[45] Date of Patent: Sep. 27, 1988

[54] DEVICE FOR DECREASING SIDE STREAM SMOKE OF TOBACCO PRODUCTS

[75] Inventors: Sakio Ikeda, Nagareyama; Sadao Nakano, Iwatsuki; Toshiyuki Nishijima, Hiki, all of Japan

[73] Assignee: Dynic Corporation, Kyoto, Japan

[21] Appl. No.: 841,875

[22] Filed: Mar. 20, 1986

[30] Foreign Application Priority Data

Mar. 22, 1985 [JP] Japan ..... 60-56059

[51] Int. Cl.[4] ..... A24D 3/04; A24F 13/04

[52] U.S. Cl. ..... 131/331; 131/194; 131/195

[58] Field of Search ..... 131/331, 332, 194, 195

[56] References Cited

U.S. PATENT DOCUMENTS

| | | | |
|---|---|---|---|
| 198,075 | 12/1887 | Brisbane . | |
| 1,770,616 | 7/1930 | Kean . | |
| 2,285,057 | 6/1942 | Russell | 131/194 |
| 2,644,464 | 7/1953 | Lancaster | 131/194 |

*Primary Examiner*—V. Millin

*Attorney, Agent, or Firm*—Frishauf, Holtz, Goodman & Woodward

[57] ABSTRACT

A device for a cigarette comprises many plate units with a cigarette holding hole that are connected with each other detachably. Inserting a cigarette into the hole of the device when lit and not puffed, side smoke stream from the burning point of the cigarette can be decreased so as not to affect the health of non-smoker persons.

17 Claims, 6 Drawing Sheets

FIG. 2
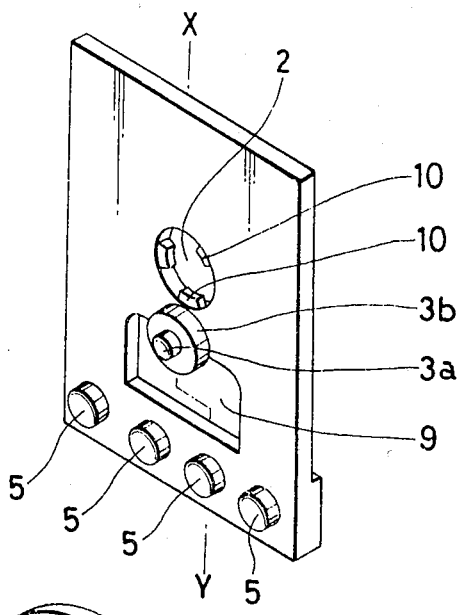
FIG. 4A
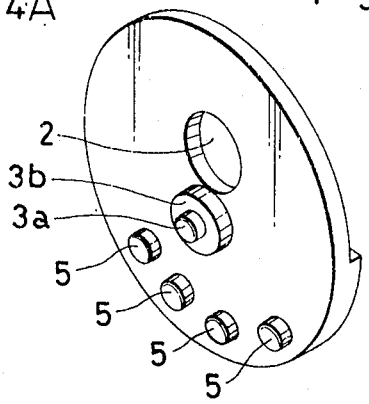
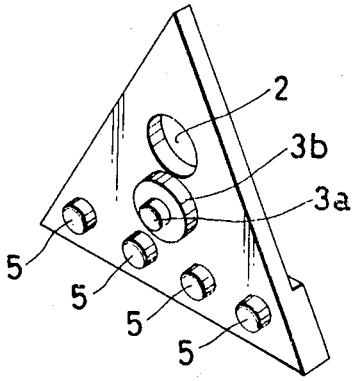
FIG. 4B
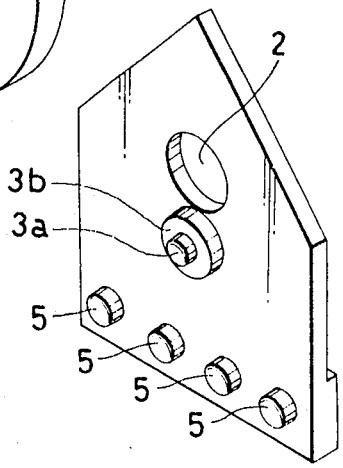
FIG. 4C

DEVICE FOR DECREASING SIDE STREAM SMOKE OF TOBACCO PRODUCTS

BACKGROUND OF THE INVENTION

This invention relates to a smoking device which may perform to decrease smoke current generated from a burning point of cigarette, namely side stream smoke, when the cigarette is not puffed under the lit condition.

Smoke current, generated when smoking, comprises two kinds; primary smoke current exhaled by a smoker and side stream smoke generated from the burning point of cigarette. It is well known that this side stream comes to be inhaled by people near the smoker and badly affects them. In this connection, it is known that the ratio of the injurious substances contained in the primary smoke current and side stream smoke is described as shown in the following table I.

TABLE I

| Injurious substances | Ratio of injurious substances in side stream smoke and primary smoke current |
|---|---|
| Tar | 2.1–3.4 |
| Nicotine | 1.8–2.8 |
| Benzopylen | 3.9 |
| Carbon monoxide | 4.7 |

As the table I is self-explanatory, the quantity of injurious substances contained in the side stream smoke is twice or three times higher than that in the primary smoke current, thus it comes that the non-smokers who are consequently compelled to inhale the side stream smoke because being near the smoker, are exposed to suffer from harm to their health more than the smoker himself does.

As one measures against the side stream smoke, the inventors of this invention have developed a certain technique enabling a smoking instrument to arrest the generation of side stream smoke, and have suggested a smoking device for it.

In other words, a burning point of cigarette is inserted into and held in a cylinder having a plurality of openings on the peripheral wall so as to arrest the side stream smoke generated from the burning point of cigarette. Such a technique has been developed and disclosed in U.S. Pat. No. 4,638,819.

SUMMARY OF THE INVENTION

Holding a burning point of a cigarette into a cylinder having a plurality of openings on the peripheral wall will result in controlling proper air supply to the burning point and preventing the side steam smoke, while extending the combustion time of the cigarette. However the cylinder shape makes it extremely troublesome to clean the inside of the cylinder. On the other hand, for reason of being a cylinder, its length, namely the length of the cylinder hole for holding the cigarette, is naturally fixed and unadjustable to meet the variety of the possible utility conditions.

This invention provides a device for decreasing side stream smoke that can facilitate the cleaning job and freely adjust the length of cylinder hole for holding a cigarette depending on the cigarette length involved, as well as the original effect of decreasing side stream smoke of cigarette.

In other words, this invention is based on the technique that when a cigarette burning point is held within the cylinder constructed so as to control air supply properly, the side stream smoke generated from the cigarette burning point is to be reduced, and the key point of the invention is to join detachably several plate units having a cigarette holding hole—the hole diameter being almost the same as or larger than an average diameter of a cigarette—at a certain interval in such a manner as each hole is correspondingly positioned one after another, and thus to provide the device that can hold the burning point in the series of holes to decrease the cigarette side stream smoke when smoking.

As previously mentioned, under the technique to decrease the side stream smoke by holding the burning point within the cylinder, it is necessary to provide for an adequate supply of air into the cylinder to keep a good balance between the prolongation of the cigarette combustion and the decreasing effect to the side stream smoke. The inventors concerned have already completed the technique to make the proper opening (for instance, slot) on the cylinder wall, as disclosed in U.S. Pat. No. 4,638,819.

Apart from the said technique, this invention has been completed from the view point that if a plurality of body units provided with a hole are coaxially jointed together at some intervals so as to hold a cigarette, it is possible to obtain the same function as a cylinder block with openings on its wall.

Under this invention, one body having a hole near the center to hold a cigarette (hereinafter called a plate unit) is to be used as a unit to be joined with others. If such plate units be merely joined closely without any interval, they would be the same as a simple cylinder block having a through hole, and would also fail to produce the function to decrease side stream smoke of cigarette which is the original object of this invention.

When some units of the plate having a hole are joined together at a proper interval so that the respective holes therein are aligned, it can be said that they have made up a proper length of cigarette holding hole consisting of some numbers of opening (hereinafter called a formative hole).

This invention is characterized in that the plate units with a hole are designed to be joined together at some intervals and are also designed to join and separate freely, while having the interval performed to introduce a proper amount of air.

Being such a novel construction, this invention can decrease the side stream smoke generated from the cigarette burning point when being lit and not puffed by holding and inserting the burning point into the formative hole. Further, since the joints are detachable, each plate unit, after being separated one after another, may easily be cleaned and accordingly the complete cleaning of the formative hole can be done with ease. When making up the formative hole, the desired length of the formative hole may be established in accordance with the contemplated usage of the formative hole.

BRIEF DESCRIPTION OF THE DRAWING

FIG. 2 is another plate unit embodying this invention.

FIGS. 4A, B and C show the sheet substances in different shape embodying this invention.

DESCRIPTION OF THE PREFERRED EMBODIMENT

Figure 1A:
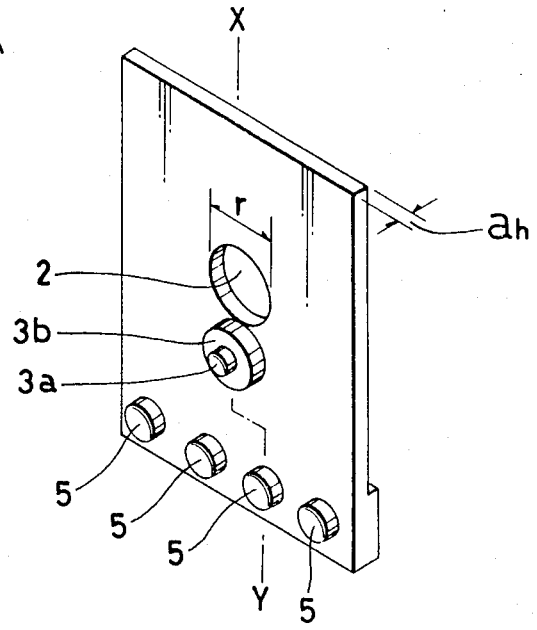
FIG. 1A is a perspective view to show an example of the plate unit embodying this invention.
Figure 1B:
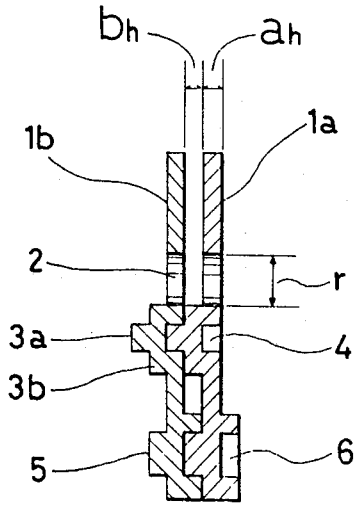
FIG. 1B is a view in section taken along the line X–Y of two joined pieces of the plate unit.

The present invention is explained with the embodiments as follows. The drawings show an example embodying this invention, and FIG. 1A represents a perspective view to show an embodiment of the plate unit of this invention, whereas FIG. 1B is a sectional view of two joined or stacked units of plate unit 1*a*, 1*b* taken along the line X–Y. In other words, as shown in FIG. 1A, the plate unit 1 is provided with a hole 2 and two-stepped protrusion 3 near the center. The lower part is provided in parallel with some of one-stepped protrusions 5. The back side of the plate unit 1 is provided with a recess 4 corresponding to a two-stepped protrusion 3, and a recess 6 corresponding to a one-stepped protrusion 5. The respective protrusions and recesses all are placed in corresponding positions on each plate unit, and when joined together, each plate unit 1*a*, 1*b* may be joined so that holes 2 therein are in alignment. For holding a cigarette in the center of the hole, the inner wall of the hole for cigarette holding may be provided with projections 10 as illustrated in FIG. 2A. When the second protrusion 3*a* of 3 is inserted into the recess 4, the first protrusion 3*b* of two-stepped protrusion 3 will keep the spacing of thickness $b_h$ between the two, and they are detachably joined. In addition, inserting the one-stepped protrusion 5 into the recession 6 will serve as a supplemental connection to stabilize the joint. Accordingly, in this example, the one-stepped protrusion 5 shall be a little higher than the first protrusion 3*b* of the two-stepped protrusion 3. Unless such relation is made as the one-stepped protrusion 5 is not higher than the first protrusion 3*b* of the two-stepped protrusion 3, the one-stepped protrusion 5 would not be useful.

Further, the $a_h$ in the drawing represents the thickness of a plate unit, that is the length of the hole punched in a plate unit, and r represents the diameter of the hole which is designed a little larger than an average diameter of cigarette.

Figure 3A:
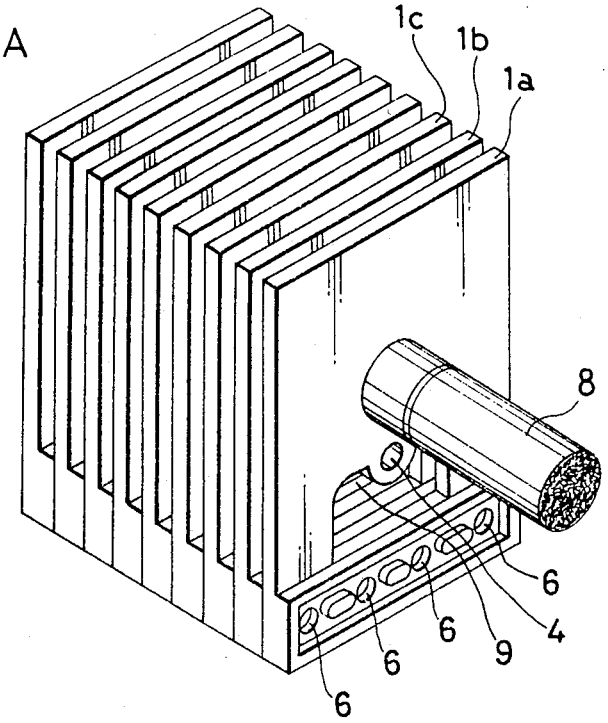
FIG. 3A is a perspective view of the device for decreasing side stream smoke of cigarette being in use.
Figure 3B:
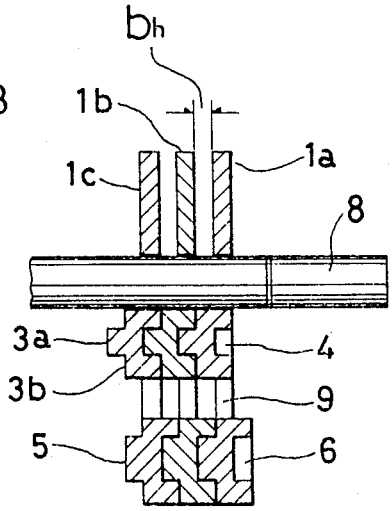
FIG. 3B is a sectional view thereof.

FIGS. 3A, B indicate the usage of the device for decreasing side stream smoke of this invention, that is some of plate unit 1 are joined together by insertion of the two-stepped protrusion 3 and the first protrusion 5 into the recesses 4 and 6 respectively. A cigarette 8 is held in a formative hole made up after joined several plate units 1 are. With this arrangement, a formative hole is prepared with a space $b_h$, which may control air flow through the space $b_h$ to prolong the cigarette combustion.

If the plate unit is too large by a certain extent, the partitions formed by each plate unit will prevent air flow into the hole for cigarette insertion. Thus the combustion time of a cigarette will be extremely shortened in the hole for cigarette holding. Therefore it is necessary to provide besides the cigarette holding hole 2, a proper opening on the plate unit as illustrated in FIGS. 2, 3, 5, 6 and 8 in order to help the air flow.

Take for example the device for decreasing side stream smoke of this invention comprising of nine plane units each made of a 42 cm×÷mm plastic plate which is punched with a hole 10 of 9 mm in diameter for cigarette holding. The following table indicates the states of combustion time of lit cigarette in the cigarette holding hole when, apart from the cigarette holding hole 2, another opening 9 is provided on the plate unit 1, and when the opening 9 is closed in the above case.

TABLE II

| Time lapse after insertion | 30 sec | 60 sec | 120 sec | 180 sec | 210 sec |
|---|---|---|---|---|---|
| With another hole besides holding hole | 10 pcs | 10 pcs | 10 pcs | 6 pcs | nil |
| With no hole besides holding hole | 7 pcs | nil | — | — | — |

Remark: The way of testing After ignited, a cigarette was puffed for 2 seconds at a rate of 30 ml/sec, and then rested for 90 seconds to stabilize the combustion, thus the cigarette was inserted in the cigarette holding hole. After a certain time of lapse, the number of cigarettes in which combustion was still continuing in the hole was counted. Ten pieces of cigarette were tested.

It is apparent from the table II that in the case of no opening being provided apart from the holding hole 2, all of the cigarette ceased burning after 60 seconds, while in case of another opening being provided besides the holding hole, some can continue burning three or more minutes.

The plate unit in this invention comprising a stackable unit may be made of materials which are not combustible by cigarette fire, as for instance, metal, synthetic resin, etc., and is not restricted in shape, size; for instance not only oblong but circle, polygon, etc. as illustrated in FIGS. 4A–C, any will do.

It is not problematic when the thickness range of the plate unit is even 1–20 mm or so. However the preferred thickness is 2–7 mm or so.

Figure 5A:
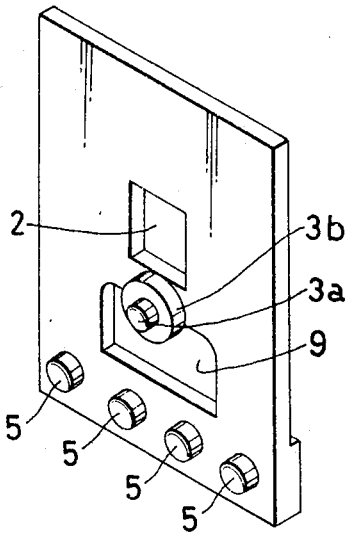
FIGS. 5A, B show the plate unit having a cigarette holding hole in different shape embodying this invention.
Figure 5B:
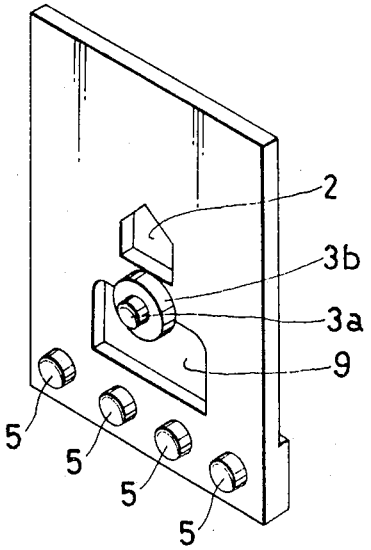

Meanwhile, when the hole 2 provided in the plate unit 1 is a circle of diameter r as depicted in FIG. 1A, a little larger hole than the average diameter of cigarette is preferred. However a circle is not always required, but a square, a pentagon, etc. as depicted in FIGS. 5A, B will do. In case of a circular hole, take an average diameter of cigarette as R mm, and the preferred diameter r shall be R mm−(R+4)mm. The simplest method possible, no matter whatever the method may be, is preferred as to how to detachably join each plate unit. As an example, it is suggested that recesses, protrusions should be properly positioned in each plate unit and that the method to join together by ways of inserting the protrusions 3, 5 into the recessions 4, 6 as illustrated in each drawing.

Figure 9:
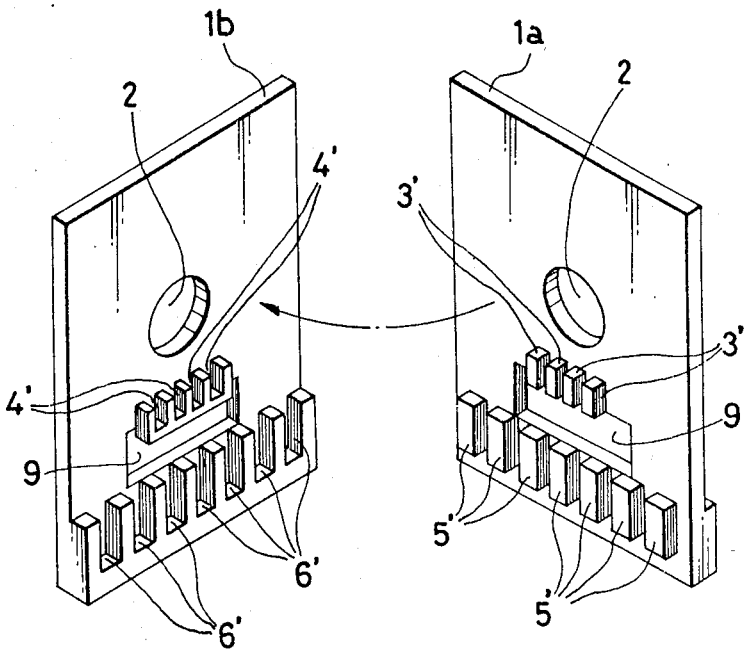
FIG. 9 shows another way to attach plate units.

Plate units can be also attached together by inserting attaching parts 3', 5' into receiving slots 4', 6' as shown in FIG. 9.

Figure 6:
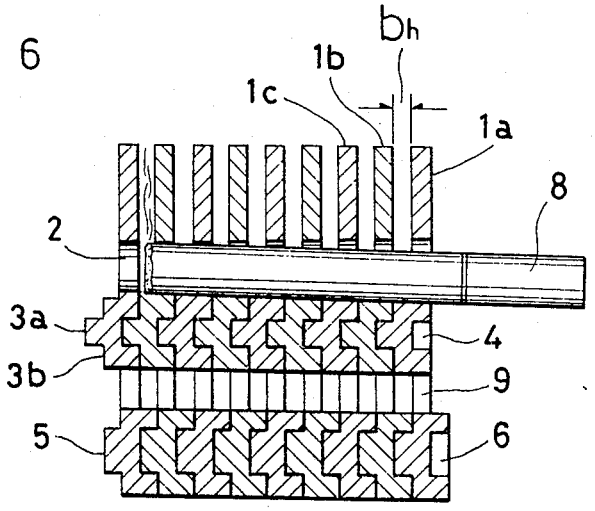
FIG. 6 is another embodiment of this invention.

Yet again, all of the holes punched in each joinable plate unit are not always required to be the same in size, and the hole can be designed to be larger one after another toward the inlet of the cigarette insertion as shown in FIG. 6.

Figure 7:
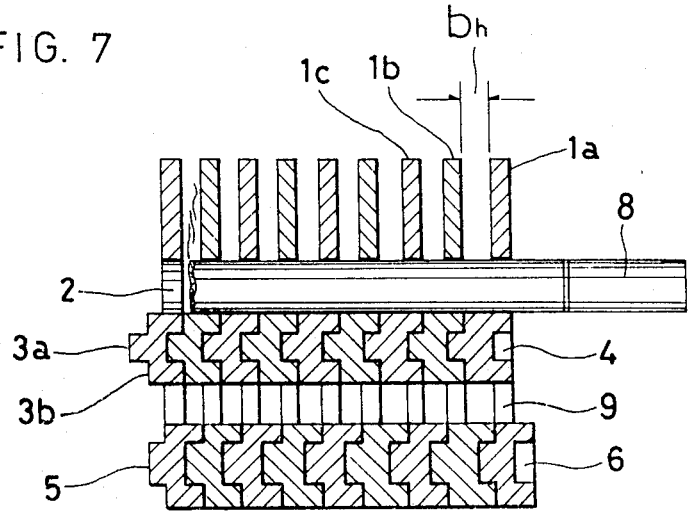
FIG. 7 shows the device for decreasing cigarette side stream smoke of this invention, each plate unit of which is placed in different intervals.

If the space $b_h$ created by each plate unit 1 in making up the formative hole is too large, the efficiency of decreasing side stream smoke may be lowered whereas the smuggling time of cigarette combustion will be shortened if the space is too narrow. The preferred space $b_h$ of this invention is 0.5 mm–3.0 mm in size. However the spaces among the plate units are allowed to be different as shown in FIG. 7.

Figure 8:
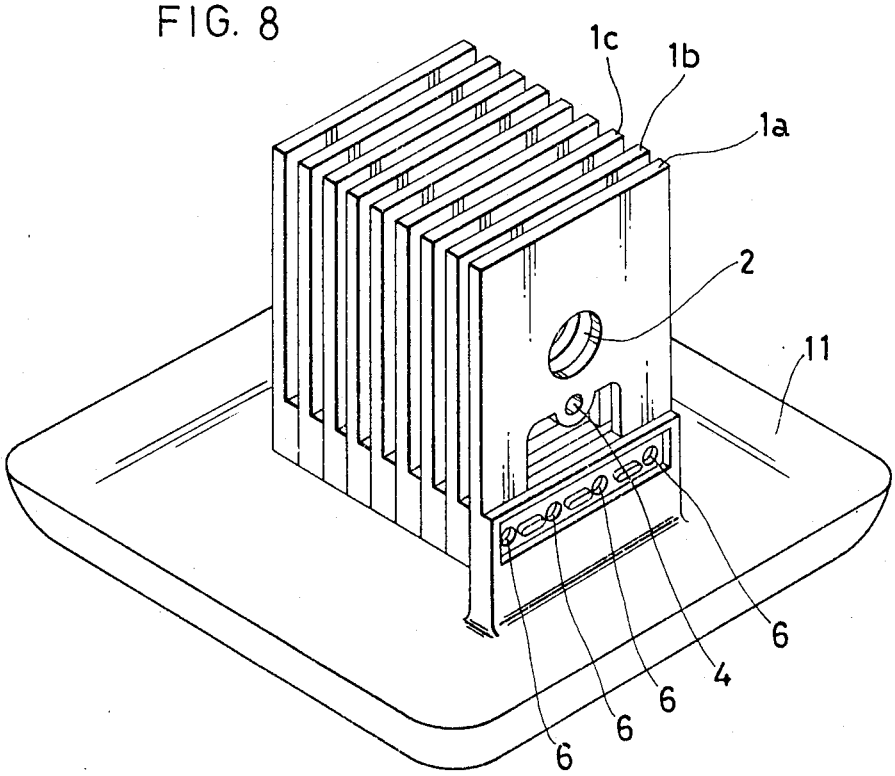
FIG. 8 shows the device, mounted on an ash tray, for decreasing cigarette side stream smoke of this invention.

The device for decreasing side stream smoke of this invention can contain a device which is mounted with ash tray to receive cigarette ash at the bottom of the plate unit 1*a* as shown in FIG. 8.

In general, it is convenient to use this device by placing it directly on a conventional ash tray. Under this usage, the sufficient effect can be produced with free selection as to the length of the formative hole.

What is claimed is:

1. An assembly for decreasing side stream smoke of a tobacco product comprising a plurality of relatively thin plates having holes formed respectively therein, said plates including means for separably joining one of said plates to another so as to form a clearance between two adjacent plates and with said holes being linearly aligned to form substantially a tubular hollow space as a tobacco product holding hole extending through said assembly for accommodating and supporting said tobacco product, and another opening apart from the tobacco product holding hole being formed for each of the plates.

2. An assembly for decreasing side stream smoke of a tobacoo product comprising a plurality of relatively thin plates having holes formed respectively therein, said plates including means for separably joining one of said plates to another so as to form a clearance between two adjacent plates and with said holes being linearly aligned to form substantially a tubular hollow space as a tobacco product holding hole extending through said assembly for accommodating and supporting said tobacco product;

wherein the inner wall of the tobacco product holding hole is provided with projections.

3. An assembly for decreasing side stream smoke of a tobacco product, said assembly having a plurality of removably joined, relatively thin plates, each of said plates comprising:

a plate portion of a given thickness and a plate portion of a reduced thickness;

a hole passing through said reduced thickness plate portion, means for removably joining one of said plates to another to have said respective given thickness plate portions in abuttment against each other with a clearance being formed between said respective reduced thickness plate portions, and for linearly aligning the respective holes in the joined plates to form substantially a tubular hollow space as a tobacco product holding hole extending through said assembly and communicating with said clearance for accommodating and supporting said tobacco product.

4. The assembly of claim 3 provided with another opening apart from the tobacco product holding hole for each of the plates.

5. The assembly of claim 3 wherein the configuration of the plate is a circle.

6. The assembly of claim 3, wherein the configuration of the plate is a polygon.

7. The device of claim 3, each of said plates having a thickness of 1–20 mm.

8. The assembly of claim 3, each of said plates having a thickness of 1–7 mm.

9. The assembly of claim 3, wherein said clearance is 0.5–3.0 mm.

10. The assembly of claim 3 wherein each clearance between adjacent plates is not the same.

11. The assembly of claim 3 wherein the size of the tobacco product holding hole increases from the tobacco product burning point toward the inlet of the tobacco product holding hole.

12. The assembly of claim 3 wherein the configuration of tobacco product holding hole is a circle.

13. The assembly of claim 3 wherein the difference between the diameter of the tobacco product holding hole and an average diameter of tobacco product is a maximum of 4 mm.

14. The assembly of claim 3 wherein the configuration of the tobacco product holding hole is a polygon.

15. The assembly of claim 3 wherein the inner wall of the tobacco product holding hole is provided with projections.

16. The assembly of claim 3 wherein a receiver for tobacco product ash is prepared.

17. An assembly for decreasing side stream smoke of a tobacco product, said assembly having a plurality of removably joined, relatively thin plates, each of said plates comprising:

a first and a second opposed surfaces, said first surface having one portion spaced at a first distance from the second surface and another portion spaced at a second, shorter distance from the second surface thereby forming plate portions of two thicknesses;

a through hole passing between the other portion of said first surface and said second surface;

means for removably joining one of said plates to another to have the one portion of said first surface of one plate engaging the second surface of another plate with a clearance being formed between the other portion of said first surface of one plate and the second surface of the other plate, and for linearly aligning the respective holes in the joined plates to form substantially a tubular hollow space as a tobacco product holding hole extending through said assembly and communicating with said clearance for accommodating and supporting said tobcco product.

* * * * *